US008245430B1

(12) United States Patent
Owenby et al.

(10) Patent No.: US 8,245,430 B1
(45) Date of Patent: Aug. 21, 2012

(54) METHOD AND APPARATUS FOR DISRUPTING COMPONENTS OF EXPLOSIVE DEVICES

(75) Inventors: Rodney N. Owenby, Albuquerque, NM (US); Larry E. Henderson, Eubank, KY (US)

(73) Assignee: Sandia Corporation, Albuquerque, NM (US)

( * ) Notice: Subject to any disclaimer, the term of this patent is extended or adjusted under 35 U.S.C. 154(b) by 373 days.

(21) Appl. No.: 12/568,774

(22) Filed: Sep. 29, 2009

(51) Int. Cl.
*F42B 33/06* (2006.01)

(52) U.S. Cl. ..... 42/84; 86/50

(58) Field of Classification Search ..... 42/84, 1.05; 86/50

See application file for complete search history.

(56) References Cited

U.S. PATENT DOCUMENTS

| | | | | |
|---|---|---|---|---|
| 2,416,712 | A * | 3/1947 | Parker | 42/76.01 |
| 2,805,604 | A * | 9/1957 | Humphrey | 89/135 |
| 3,577,923 | A * | 5/1971 | Perkins et al. | 102/472 |
| 4,046,055 | A * | 9/1977 | McDanolds et al. | 86/50 |
| 4,062,112 | A * | 12/1977 | Lake | 86/50 |
| 4,169,403 | A | 10/1979 | Hanson | |
| 4,779,511 | A | 10/1988 | Proctor et al. | |
| 4,957,027 | A | 9/1990 | Cherry | |
| 5,210,368 | A * | 5/1993 | Heller et al. | 86/50 |
| 5,515,767 | A | 5/1996 | Gilbert | |
| 5,542,354 | A * | 8/1996 | Sigler | 102/478 |
| 6,298,763 | B1 | 10/2001 | Greenfield et al. | |
| 6,644,166 | B2 | 11/2003 | Alexander et al. | |
| 7,228,778 | B2 | 6/2007 | Edwards et al. | |
| 2008/0254738 | A1 | 10/2008 | Brumley et al. | |
| 2009/0189091 | A1 | 7/2009 | Holly et al. | |

OTHER PUBLICATIONS

Remington, Owner's Manual, Instruction Book for: Model 700 EtronX Bolt Action Centerfire Rifle, [Retrieved on Sep. 21, 2009]. Retrieved From the Internet: <URL:http://www.remington.com/pdfs/om/om_700etronx.pdf>, 24 pages.

* cited by examiner

*Primary Examiner* — Stephen M Johnson
(74) *Attorney, Agent, or Firm* — Madelynne J. Farber

(57) ABSTRACT

A system, a firing apparatus and method for disrupting at least one electrical component of an explosive device are provided. The system has an electrical cartridge, the firing apparatus and an initiator. The electrical cartridge has a projectile at an end thereof deployable into the electrical component(s). The firing apparatus has a barrel, a breech and an electrical contact. The barrel has a firing end aimable toward the electrical component, and a passage therein for receiving the electrical cartridge. The breech is operatively connectable to the barrel. The electrical contact is positionable in the breech in operative contact with the electrical cartridge. The electrical contact is operatively connectable to the initiator. The initiator selectively provides an electrical signal to the electrical cartridge via the electrical contact whereby the electrical cartridge may be activated to deploy the projectile from the firing end of the barrel.

34 Claims, 10 Drawing Sheets

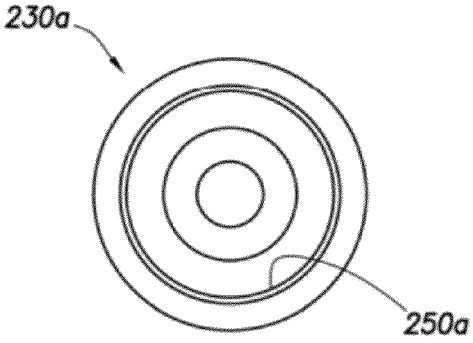
FIG.5A1
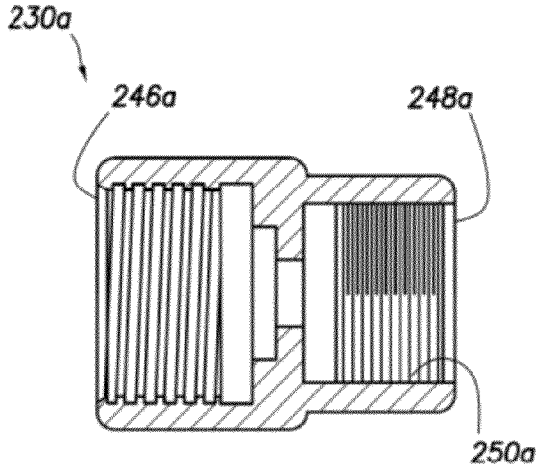
FIG.5A2
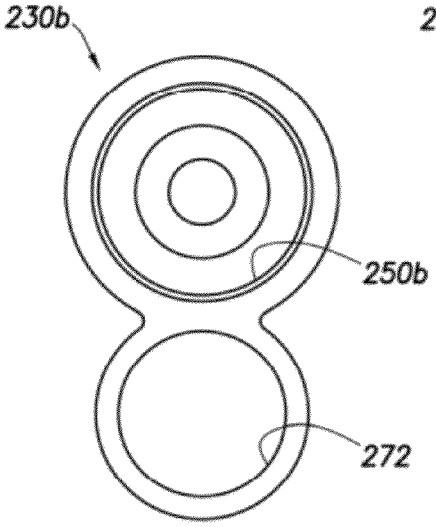
FIG.5B1
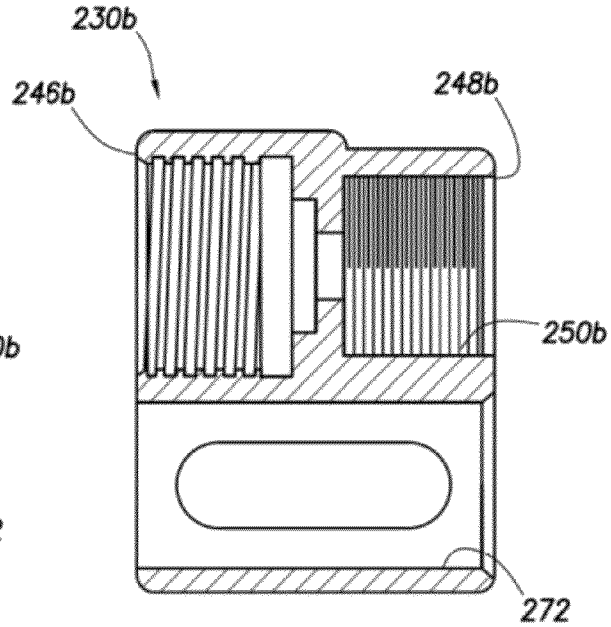
FIG.5B2

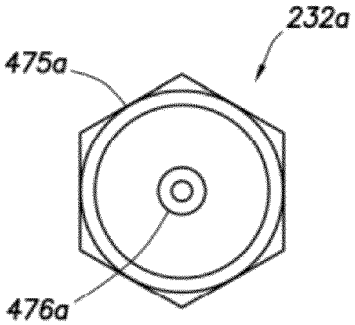
FIG.6A1
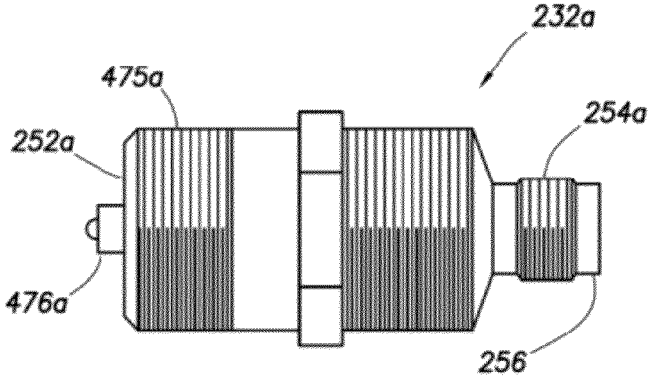
FIG.6A2
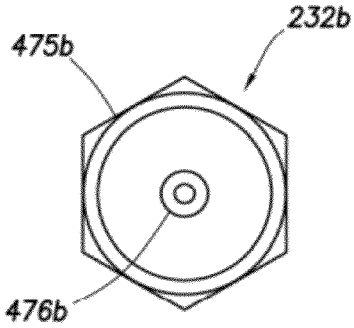
FIG.6B1
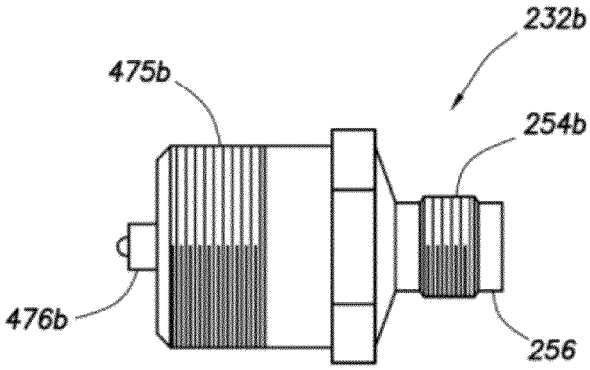
FIG.6B2

METHOD AND APPARATUS FOR DISRUPTING COMPONENTS OF EXPLOSIVE DEVICES

STATEMENT OF GOVERNMENT INTEREST

This invention was developed under Contract DE-AC04-94AL85000 between Sandia Corporation and the U.S. Department of Energy. The U.S. Government has certain rights in the invention.

BACKGROUND OF THE INVENTION

1. Field of the Invention

The present invention relates to techniques for disabling an explosive device to prevent activation thereof. More particularly, the present invention relates to techniques for disrupting components of an explosive device, such as electrical components used in the activation of the explosive device.

2. Background of the Related Art

Explosive devices typically contain highly volatile explosive materials that can generate explosions and cause significant damage to persons and/or property upon activation. Explosive devices also typically contain components, such as firing trains and other electrical components, used to activate the explosive material to cause an explosion. Due to the potential damage caused by an explosive device, it is often necessary to disable such devices to prevent activation of the explosive material.

Disabling an explosive device can be an extremely dangerous activity for those responsible for performing the disabling operation, as well as those in proximity to the explosive device. Various techniques have been developed to disable explosive devices, such as remote and/or controlled activation (e.g., by activating the explosive device within a safe location), deactivation (e.g., by disconnecting the detonator), and/or robotic manipulation (e.g., by deploying a robot to move, activate or deactivate the explosive device). However, such techniques may not be feasible, for example, in situations where there is a high risk involved in moving, activating or deactivating the explosive device using the proposed technique(s).

Other attempts have been made to provide techniques for disabling explosive devices. For example, techniques have been developed for deploying projectiles or substances into explosive devices as described in U.S. Pat. Nos. 4,046,055; 4,169,403; 4,779,511; 4,957,027; 5,210,368; 5,515,767; 6,298,763; 6,644,166; and 7,228,778. However, it may not always be feasible to deploy such projectiles or substances into explosive devices, for example, in situations where the projectile or substance may activate the explosive material and trigger an explosion.

In some situations, it may be desirable to affect only the electrical components within the explosive device. Attempts have been made to disable the explosive device by affecting electrical components of the explosive device. For example, wires may be cut as described in U.S. Pat. No. 4,062,112; the electronics may be affected as described in US Patent Application. No. US2009/0189091; or transmissions suppressed as described in US Patent Application No. 2008/0254738. In some cases, it may not be feasible to affect certain electronics, for example, where the electronics are difficult to access using the proposed techniques.

Despite the development of techniques for disabling explosive devices, there remains a need to provide advanced techniques for disrupting specific components of the explosive device. It may be desirable to have the capability of easily accessing and disrupting certain components within the explosive device, such as electrical components used in the operation of the explosive device. Preferably, such disruption renders the explosive device incapable of activation, thereby neutralizing the explosive device without activating the explosive material. It may be further desirable to provide for inspection of the explosive device before, during and/or after the disruption operation. Preferably, such capabilities involve one or more of the following, among others: miniature configuration, handheld operation, compact operability, portability, easy assembly and use, transportability, accuracy, operation in difficult conditions, durability, simple operation, disruption of select components preferably without affecting other components, disabling explosive devices and/or components without detonation, visually inspecting the explosive device, operability by single and/or multiple operators, etc.

BRIEF DESCRIPTION OF THE DRAWINGS

So that the features and advantages of the present invention can be understood in detail, a more particular description of the invention may be had by reference to the embodiments thereof that are illustrated in the appended drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

FIG. 5A1 is a horizontal cross-sectional view of the breech of FIG. 2A taken along line 5A1-5A1. FIG. 5A2 is a longitudinal cross-sectional view of the breech of FIG. 2A taken along line 5A2-5A2. FIG. 5B1 is a horizontal cross-sectional view of the breech of FIG. 2B taken along line 5B1-5B1. FIG. 5B2 is longitudinal cross-sectional view of the breech of FIG. 2B taken along line 5B2-5B2.

FIG. 6A1 is an end view of the electrical contact of FIG. 2A. FIG. 6A2 is plan view of the electrical contact of FIG. 2A. FIG. 6B1 is an end view of the electrical contact of FIG. 2B. FIG. 6B2 is a plan view of the electrical contact of FIG. 2B.

DETAILED DESCRIPTION OF THE INVENTION

Presently preferred embodiments of the invention are shown in the above-identified Figures and described in detail below.

Figure 1A:
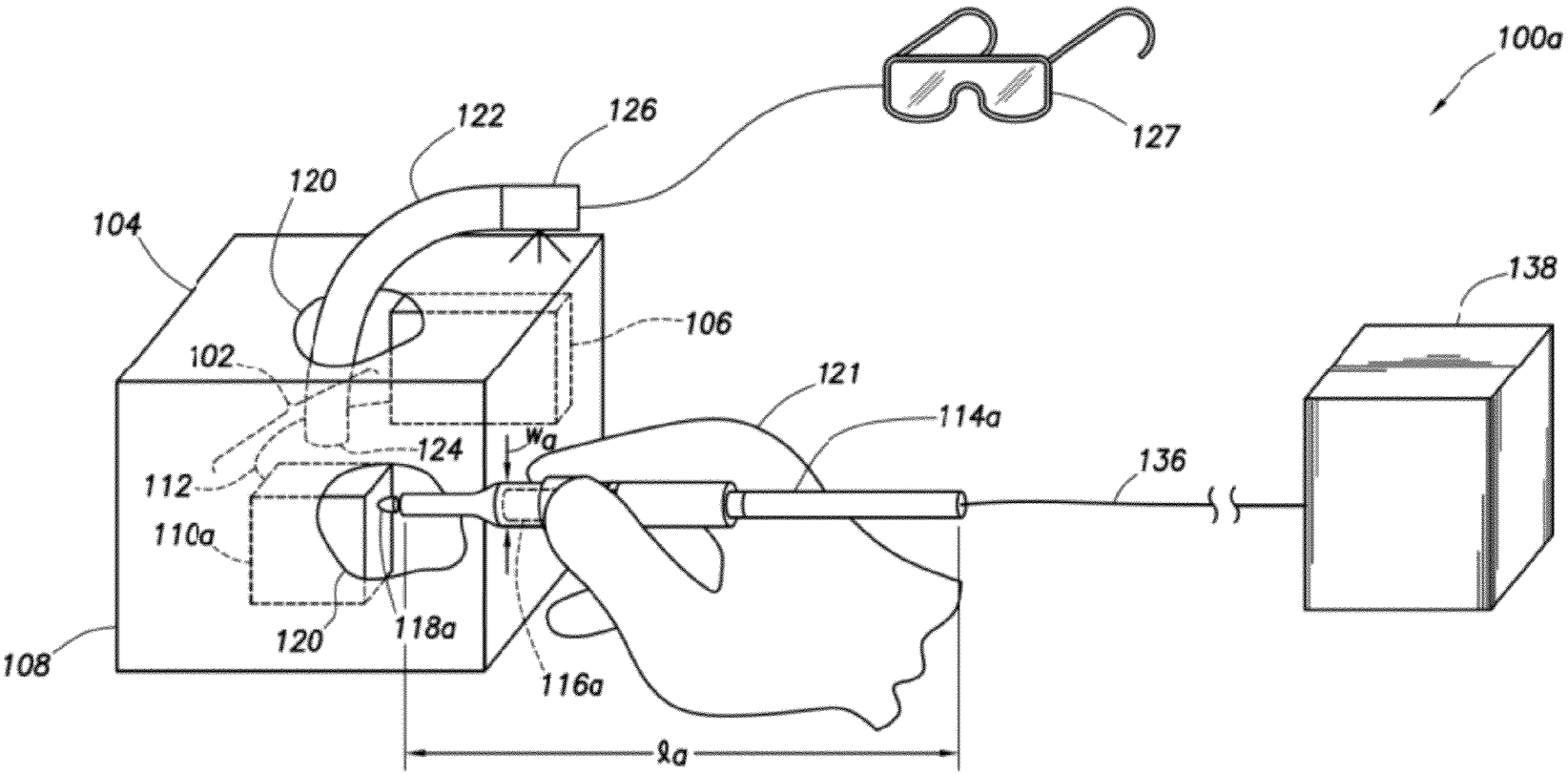
FIG. 1A is an exemplary graphical depiction of a system for disrupting an electrical component of an explosive device, the system comprising a firing apparatus with a separate scope.
Figure 1B:
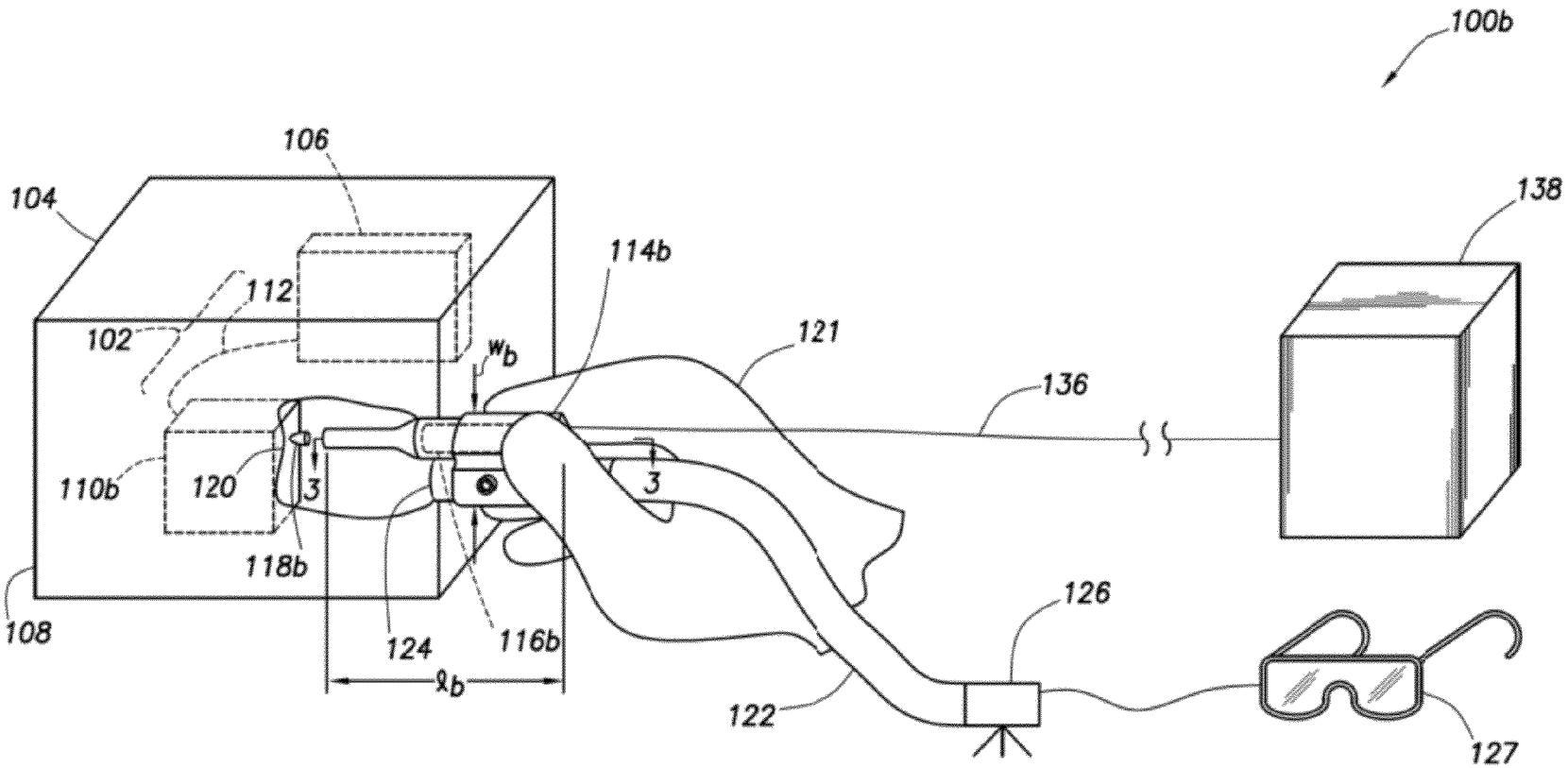
FIG. 1B is an exemplary graphical depiction of a system for disrupting an electrical component of an explosive device, the system comprising an alternate firing apparatus with a combined scope.

FIGS. 1A and 1B depict systems 100*a,b* for disrupting electrical components 102 of an explosive device 104. Preferably, the systems 100*a,b* disrupt the electrical component(s) 102 in a manner that prevents the explosive device 104 from generating an explosion. The explosive device 104 may be any type of device suspected of containing an explosive material 106 that may be capable of generating an explosion. As shown in FIGS. 1A and 1B, the explosive device 104 includes a housing 108 with the electrical component 102 and the explosive material 106 therein.

The explosive device 106 may be, for example, a pipe bomb, an improvised explosive device or other device containing material(s) that may generate an explosion. The explosive device 106 has a housing 108 containing the explosive material 106 and an electrical component 102 for activating the explosive material 106. The housing 108 may be any material, such as a pipe, case, box, backpack, or other packaging capable of holding the explosive material 106 and electrical component 102. The housing 108 may have one or more compartments in various configurations. One or more housings 108 may be provided.

The explosive material 106 may be any material suspected of or actually being capable of generating an explosion, such as C4, TnT, dynamite, fuels, chemicals, casted and/or other volatile materials. The explosive material 106 may have volatile and/or non-volatile materials that are combinable to form volatile materials. While not all suspected explosive material will actually be explosive, such suspected explosive material will be treated as an explosive material. Other items may also be present in the explosive device 104, such as nails, pipes, and/or other items (not shown). One or more explosive materials 106 and/or other items may be arranged in or about the housing 108.

The electrical component 102 is operatively connected to explosive material 106 for selective activation thereof. The electrical components 102 may be any device or devices capable of activating the explosive material 106 such that an explosion is generated, such as a detonator, firing train, battery, power supply, wiring, transmitter, receiver, conductor, dielectric and/or other electrical devices and/or combinations thereof and any associated containers. The electrical component may also include one or more non-electrical parts used in combination with the electrical device(s) 102 to provide actuation of the explosive material 106. The electrical component 102 of FIG. 1A is depicted as a battery 110*a* with wiring 112 electrically connected to the explosive material 106. The electrical component 102 of FIG. 1B is depicted as a power supply 110*b* with wiring 112 electrically connected to the explosive material 106. Other configurations of electrical devices may be used as the electrical component 102.

The systems 100*a,b* of FIGS. 1A and 1B each depict a firing apparatus 114*a,b* (sometimes referred to as a 'component killer') for disrupting (sometimes referred to as 'killing') the electrical component(s) 102 of the explosive device 104. Preferably, the firing apparatuses 114*a,b* are miniature, handheld devices easily positionable about the explosive device 104. As shown, the firing apparatuses 114*a,b* are held in the hand of the operator 121 and positioned about the explosive device 104.

The firing apparatuses 114*a,b* are preferably of a handheld size, and preferably configured for transportability, manipulation and handling. One example of a desired configuration may be a firing apparatus having dimensions similar to a writing, eating or other common utensil that most or all operators are likely to be familiar with.

While the device may be made of any size, the firing apparatus is preferably miniature such that it can be handheld. Preferably, the firing apparatus is preferably miniaturized such that it has a length of less than about 6 inches (15.24 cm) and a maximum width of less than about 3 inches (7.62 cm). As shown in FIG. 1B, the firing apparatus 114*a* (with the scope 122) has a length (lb) of about 2-3 inches (5.08 cm), and a width (wb) of about 1 inch (2.54 cm). As shown in FIG. 1A, the firing apparatus 114*a* has a length (la) of about 10-12 inches (25.40-30.48 cm) and a width (wa) of about 0.5 inches (1.27 cm). The length of the firing apparatus 114*a* in FIG. 1A has been extended by adding tubes or rods as will be described further herein.

As shown, the firing apparatuses 114*a,b* are preferably positioned through opening(s) 120 in the explosive device 104 by the operator 121. One or more opening(s) 120 may be provided. In some cases, the opening(s) 120 may be pre-existing in the explosive device 104, or added prior to use. The opening(s) 120 may be formed by various techniques, such as drilling, perforating, piercing or otherwise penetrating the housing 108. In some cases, no pre-existing opening 120 may exist in the explosive device 104. In such cases, it may be possible to penetrate the housing 108 with the firing apparatus 114*a,b* or other means to create an opening 120 for passing the firing apparatus 114*a,b* therethrough. The firing apparatuses 114*a,b* may be disposed into or near one or more such openings during operation. Preferably, the firing apparatuses 114*a,b* are positioned about the opening 120 and aimed at the electrical component 102.

The firing apparatuses 114*a,b* are provided with cartridges 116*a,b* having projectiles 118*a,b* deployable from the firing apparatus upon activation of the cartridge as will be described further herein. As shown in FIGS. 1A and 1B, the firing apparatus 114*a,b* preferably deploys the projectile 118*a,b* into the electrical component 102 of the explosive device 104. However, it will be appreciated that apparatuses 114*a,b* may be used to deploy a projectile 118*a,b* into any portion of the explosive device 104.

Preferably, the operator 121 aims the firing apparatus 114*a,b* toward the electrical component 102 and activates the cartridge 116*a,b*. The apparatuses 114*a,b* each are operatively linked to an initiator 138 via a link 136 for providing an electrical signal to the firing apparatus 114*a* and activating the cartridge 116*a,b* as will be described further herein. Once activated by the operator 121, the firing apparatus 114*a,b* deploys the projectile 118*a,b* into the explosive device 104. Preferably, the projectile 118*a,b* is deployed into the selected electrical component 102 of the explosive device 104, thereby deactivating the explosive device 104.

As shown in FIG. 1A, the projectile 118*a* penetrates the battery 110*a* of the electrical component 102 such that the operation of the battery 110*a* is disrupted. As shown in FIG. 1B, the projectile 118*b* severs the wiring 112 of the electrical component 102 such that the operation of the wiring 112 is disrupted. The disruption of the battery 110*a* and wiring 112 of the electrical components 102 preferably disables the operation of the explosive device 104 such that the explosive material 106 is prevented from exploding. In this manner, the explosive component 102 is preferably 'killed' or unable to activate the explosive material 106.

A scope 122 is preferably used in connection with the firing apparatus 114*a,b*. The scope 122 may be used separate from the firing apparatus 114*a* as shown in FIG. 1A, or operatively connected to the firing apparatus 114*b* as shown in FIG. 1B. The scope 122 is positionable about the explosive device 104 for visual inspection thereof. The scope 122 may be used to enable one or more operators 121 to inspect the electrical component 102, explosive material 106 and/or other items in or about the explosive device 104. The scope 122 may be positioned in one or more openings 120 for providing a visual image of the explosive device 104 to the operator(s) 121. The scope may be positioned in the same opening 120 as or a separate opening 120 from the firing apparatus 114*a,b*.

As shown in FIG. 1B, the firing apparatus 114*b* is configured to support the scope 122. The scope 122 is positionable in the opening 120 of the explosive device 104 with the apparatus 114*b* for visual inspection of the electrical component 102, explosive material 106 and/or other items in the explosive device 104. This 'combined' firing apparatus and scope configuration may enable some operators 121 to inspect the explosive device 104 with the scope 122 as it activates the system 100*b* to deploy projectile 118*b* therefrom. While FIG. 1B shows the scope 122 and firing apparatus 114*b* connected and positioned about the same opening 110, it will be appreciated that the scope 122 may be removed and operated separately from the firing apparatus 114*b*. As shown in FIG. 1A, the scope 122 may be positioned in a separate opening 120 from the firing apparatus 114*a*. This 'separate' configuration may be used to provide an alternate visual angle for inspecting the explosive device 102 and/or aiming the firing apparatus 114*a,b*. One or more scopes 122 may be used about the explosive device 104 for providing multiple views during operation.

The scope 122 may also be used to position the firing apparatus 114*a,b* in a desired position for deploying the projectile 118*a,b*. Preferably, the scope 122 positions the firing apparatus 114*a,b* to deploy a projectile 118*a,b* into the explosive device 104, away from the explosive material 106 and/or in alignment with the electrical component 102. Due to the volatility of some explosive materials 106, it may be desirable to avoid deploying the projectile 118*a,b* into or near the explosive material 106. In some cases, additional openings 120 may be provided such that one or more apparatuses 114*a,b* and/or scopes 122 may be positioned about the explosive device 104.

Any scope may be used in connection with the apparatus 114*a,b* to inspect the explosive device 104 and/or aim the apparatus 114*a,b*. The scope 122 is also preferably easy to maneuver about the explosive device 104 to provide images and/or outputs as desired. For example, the scope may be a borescope with a flexible tube for positioning within and/or about the explosive device.

As shown in FIGS. 1A and 1B, the scope 122 may include a lens 124, a camera 126 and a screen 127. The lens 124 may be insertable in or near the explosive device 104. Preferably, the scope 122 has a sturdy lens and a flexible body positionable in and/or about the explosive device 104 to provide inspection thereof. The lens 124 is preferably positionable adjacent the electrical component 102 and/or explosive material 106 for examination thereof. The lens 124 may also be positioned adjacent the apparatus (see, e.g., 114*b* of FIG. 1B) or separate therefrom (see, e.g., 114*a* of FIG. 1A) for aiming the apparatus 114*a,b*. The lens 124 is preferably operatively linked to a camera 126 for capturing images from the lens 124. A screen 127, such as glasses, may be used to display these images. Preferably, the operator 121 may see the screen 127 during the operation of the firing apparatus 114 *a,b*.

While FIGS. 1A and 1B depict specific configurations of the systems 100*a,b* and the explosive device 104, it will be appreciated that various configurations may be provided. For example, one or more operators 121 may be used to position one or more apparatuses 114*a/b* and/or scopes 122 about one or more openings 120 to deploy one or more projectiles 118*a,b* at the explosive device 104.

Figure 2A:
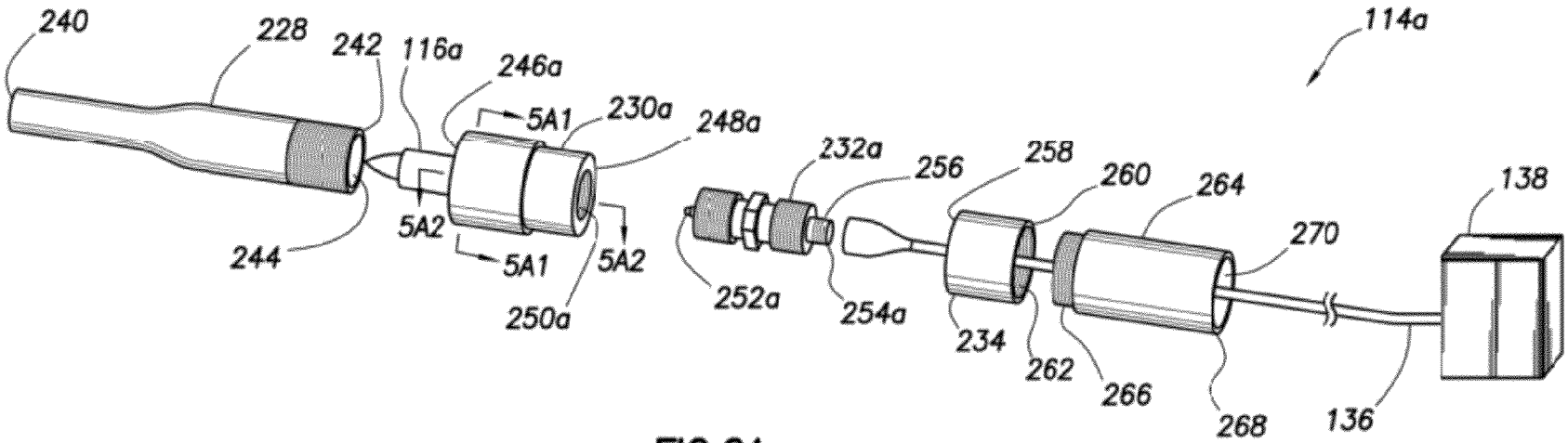
FIG. 2A is an exploded view of the firing apparatus of FIG. 1A, the firing apparatus comprising a barrel, a breech and an electrical contact.
Figure 2B:
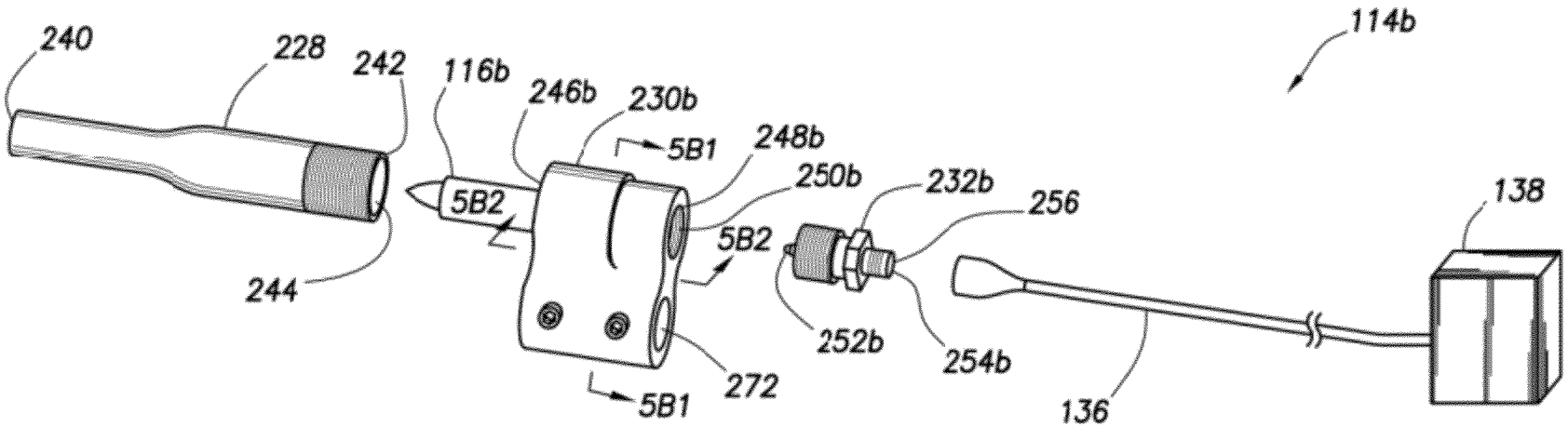
FIG. 2B is an exploded view of the firing apparatus of FIG. 1B, the firing apparatus comprising a barrel, an alternate breech, and an alternate electrical contact.

FIGS. 2A and 2B show the firing apparatuses 114*a,b* of FIGS. 1A and 1B in greater detail. FIG. 2A is an assembly view of the firing apparatus 114*a*. FIG. 2B is an assembly view of the firing apparatus 114*b*. The firing apparatuses 114*a,b* may be useable for deploying a projectile 118*a,b* into an explosive device 104 as shown, for example, in FIGS. 1A and 1B.

As shown in FIG. 2A, the firing apparatus 114*a* includes a barrel 228, a breech 230*a*, and a contact 232*a*. A tube 234 and a rod 264 are also provided. As also shown in FIG. 2A, a cartridge 116*a* is positionable in the firing apparatus 114*a*.

The barrel 228 is preferably a tubular member having a tapered firing end 240 and a threaded breech end 242 with a barrel passage 244 therethrough. The cartridge 116*a* is positionable in the barrel passage 244 for activation by the apparatus 114*a*.

Breech 230*a* is operatively connectable to the barrel 228. Breech 230*a* is a tubular member having a threaded barrel end 246*a* and a threaded contact end 248*a*. The breech 230*a* has a breech passage 250*a* therethrough for supporting the barrel 228 and contact 232*a* therein. The threaded barrel end 246*a* is preferably threadably matable with the threaded breech end 242 of the barrel 228. Preferably, a cartridge 116*a* is positioned in the barrel passage 244 of barrel 228 prior to threadedly connecting the breech 230*a* with the barrel 228.

Contact 232*a* is operatively connected to the breech 230*a*. Contact 232*a* has a threaded cartridge end 252*a* and a threaded link end 254*a*. The cartridge end 252*a* of contact 232*a* is matably threaded to the contact end 248*a* of the breech 230*a*. Preferably, contact 232*a* is also positioned in contact with the cartridge 116*a* for passing a voltage or other electrical signal thereto for activation thereof. The link end 254*a* has a receptacle 256 for matingly receiving link 136 for electrical communication therebetween.

One or more tubes 234 may be provided and operatively connected to the breech 230*a*. Tube 234 is a tubular member having a threaded breech end 258 and a threaded rod end 260 and a tube passage 262 therethrough. The threaded breech end 258 of the tube 234 is threadedly matable with the threaded contact end 248*a* of the breech 230*a*. One or more tubes 234 may be threadedly connected in series to extend the length of the firing apparatus 114*a*.

A rod 264 may also be provided and operatively connected to tube 234 for supporting the firing apparatus 114*a*. Rod 264 has a threaded tube end 266, an initiator end 268, and a rod passage 270 therethrough. Tube end 266 of the rod 264 is threadedly matable to threaded rod end 260 of tube 234. One or more rods 264 may be provided to extend the length of the firing apparatus 114*a*.

Referring now to FIG. 2B, the firing apparatus 114*b* includes a barrel 228, a breech 230*b*, and a contact 232*b*. While not shown, a scope 122 may be operatively connected to the breech 230*b* (see, e.g., 122 of FIG. 1B). As also shown in FIG. 2B, a cartridge 116*b* is positionable in the firing apparatus 114*b*.

The barrel 228 of FIG. 2B may be the same as the barrel 228 of FIG. 2A. The cartridge 116*b* is positionable in the barrel passage 244 and deployable for activation by the apparatus 114*b*. Breech 230*b* is operatively connectable to the barrel 228. Breech 230*b* is a tubular member having a threaded barrel end 246*b* and a threaded contact end 248*b*. The breech 230*b* has a breech passage 250*b* therethrough for supporting the barrel 228 and contact 232*b* therein. The breech 230*b* is also provided with a scope passage 272 therethrough for removably supporting scope 122 therein. The threaded barrel end 246*b* is preferably threadably matable with the threaded breech end 242 of the barrel 228. Preferably, a cartridge 116*b* is positioned in the barrel passage 244 of barrel 228 prior to threadedly connecting the breech 230*b* with the barrel 228.

Contact 232*b* is operatively connectable to breech 230*b*. Contact 232*b* has a threaded cartridge end 252*b* and a link end 254*b*. The cartridge end 252*b* of contact 232*b* is matably threaded to the contact end 248*b* of the breech 230*b*. Preferably, the contact 232*b* is positioned in contact with the cartridge 116*b* for passing a voltage or other signal thereto for activation thereof. The link end 254*b* has a receptacle 256*b* for matingly receiving link 136 for electrical communication therebetween.

Referring to FIGS. 2A and 2B, an initiator 138 is operatively connected to the contact 232*a,b* via a link 136. Link 136 may be positioned through the tube passage 262 of tube 234 and the rod passage 270 of rod 264, if present. Link 136 is positionable in receptacle 256 of contact 232*a,b* for operative connection therewith. Link 136 may be any electrical cable, such as an electrical firing cable or a high fidelity cable (e.g., a REYNOLDS™ industry cable), used to operatively connect contact 232*a,b* to initiator 138. The link 136 may be used to pass electrical signals, such as voltage, from the initiator 138 to the contact 232*a,b*. The link 136 may also be used to operatively connect the initiator 138 and/or the firing apparatus 114*a,b* to other devices (not shown). Preferably, the link 136 is capable of passing about 300 Volts of electricity from the initiator 138 to the contact 232*a,b*.

Initiator 138 may be a self contained electrical activator, such as a power supply or other device for sending electrical signals, such as a voltage, to the contact. Preferably, the initiator 138 is capable of supplying about 300 Volts to the contact 232*a,b* via link 136. Initiator 138 may optionally be connected to additional parts, such as a power source, computer or other device for use with the firing apparatus 114*a,b*.

While FIGS. 2A and 2B depict specific configurations of the firing apparatuses 114*a,b* assembled using threaded connections, it will be appreciated that other means of connection may be used in the assembly of the firing apparatus. Preferably, the breech 230*a,b* and contact 232*a,b* are interchangeable such that the firing apparatus may be converted between the firing apparatus 114*a* and the firing apparatus 114*b*. Other configurations of links 136 and initiators 138 capable of providing electrical signals to the tiring apparatus 114*a,b* may also be used. Additionally, while the firing apparatus 114*a* is shown using cartridge 116*a* and the firing apparatus 114*b* is shown using cartridge 116*b*, it will be appreciated that cartridges 116*a,b* may be used in either firing apparatus 114*a,b*.

Figure 3:
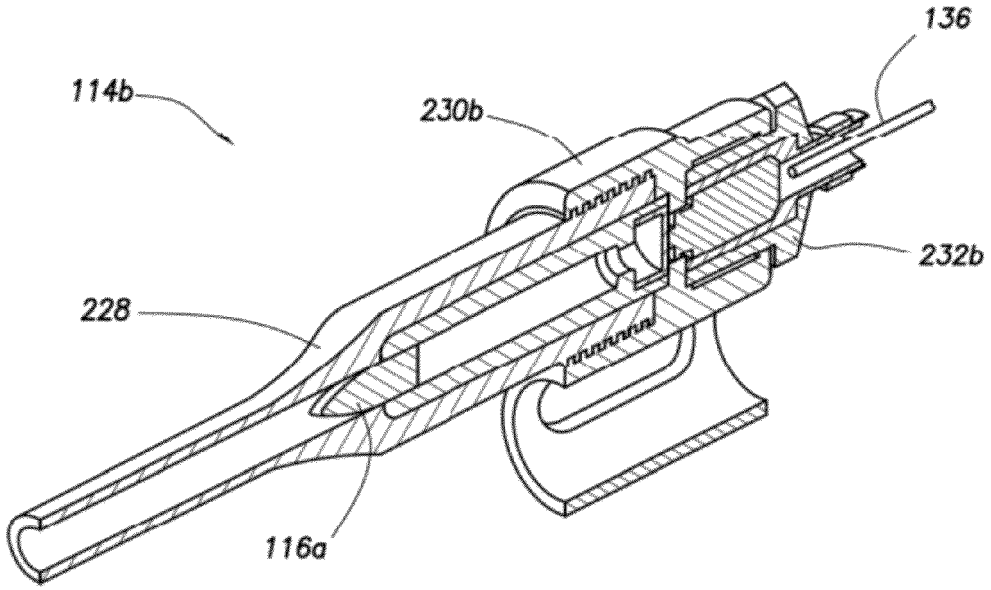
FIG. 3 is a longitudinal, cross-sectional view of the firing apparatus of FIG. 1B taken along line 3-3.

FIG. 3 is a cross-sectional view of the firing apparatus 114*b* of FIG. 2B depicting the firing apparatus in the assembled position. FIG. 3 depicts the barrel 228, breech 230*b*, contact 232*b*, and link 136 of the assembled apparatus 114*a* with a cartridge 116*a* position therein.

Figure 4A:
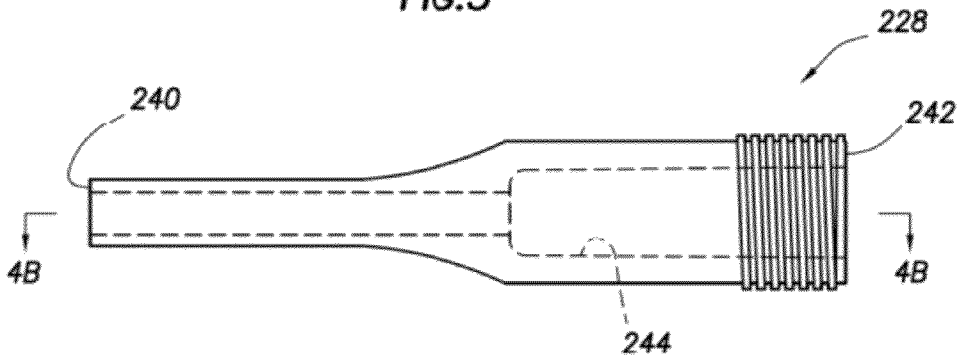
FIG. 4A is a plan view of the barrel of FIG. 2A.
Figure 4B:
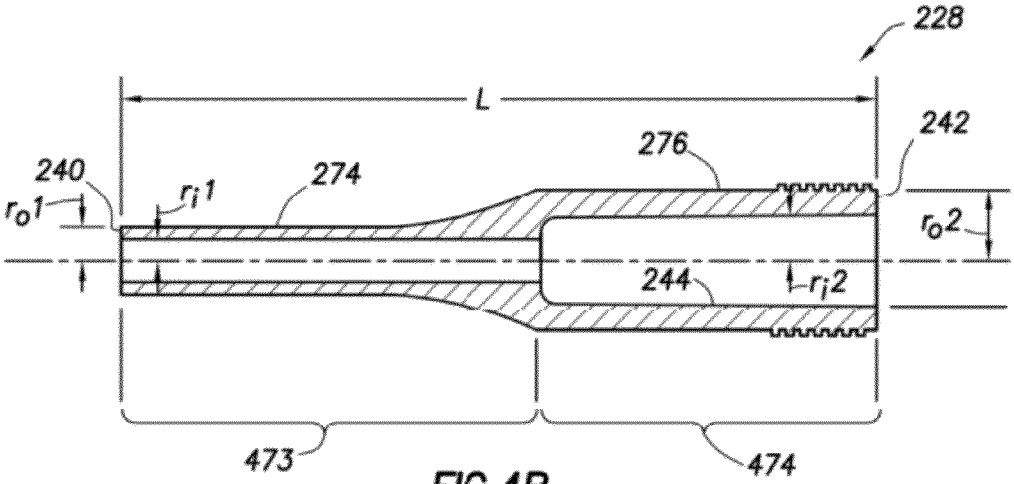
FIG. 4B is a longitudinal cross-sectional view of the barrel of FIG. 4A taken along line 4B-4B.

FIGS. 4A-6B2 are detailed views of the barrel 228, breech 230*a,b*, and contact 232*a,b* of the apparatuses 114*a,b*. The barrel 228 is shown in greater detail in FIGS. 4A and 4B. FIG. 4A is a plan view of the barrel 228. FIG. 4B is a cross-sectional view of the barrel 228 taken along line 4B-4B.

The barrel 228 has a tapered first portion 473 at a firing end 240 thereof, and a second portion 474 at the breech end 242. The second portion 474 of the barrel 228 is configured for receiving a cartridge 116*a,b* in the barrel passage 244. The passage 244 is configured such that the cartridge 116*a,b* extends through the breech end 242 of the barrel 228 and into the first portion 473 (see, e.g., FIG. 3). A projectile 118*a,b* is positionable at an end of the cartridge 116*a,b* into the passage 244 in the first portion 473 of the barrel 228. The projectile 118*a,b* is deployable through the passage 244 and out the firing end 240 of the barrel 228 upon activation of the cartridge 116*a,b*.

The barrel 228 has length (L), an inner radius ($r_i$1) defined by the passage 244 in the first portion 473 of the barrel 228, an inner radius ($r_i$2) defined by the passage 244 in the second portion 474 of the barrel 228, an outer radius ($r_0$1) at the firing end 244 of the barrel 228, an outer radius ($r_0$2) at the breech end 242 of the barrel 228. While the barrel 228 may be of any size, the barrel 228 is preferably of a miniature or compact size for handheld operation and/or positionable in openings 120 in the explosive device 104 (see, e.g., FIGS. 1A and 1B). By way of example, the barrel 228 may have a length (L) of about 2.22 inches (5.64 cm) and a maximum width ($2\times r_0$2) of about 1.0 inches (2.54 cm).

The barrel 228 is preferably configured to allow sufficient pressure buildup therein to deploy the projectile 118*a,b* upon activation of the cartridge 116*a,b* and without damage to the barrel 228. The barrel 228 is also preferably configured to withstand a firing pressure generated by a cartridge 116*a,b* as it is activated within the barrel 228 during operation. While the firing pressure may depend on the cartridge configuration, the firing pressure preferably has a maximum pressure of about 50,000 psi (344.74 MPa).

To handle the pressure generated by the cartridge during activation, the barrel 228 is preferably made of a high strength material, such as a hardened steel. The yield strength for the barrel 228 may vary depending on the desired configuration of the barrel and cartridge. The yield strength of the barrel material preferably exceeds the estimated gun yield point ($\sigma y$) as determined by the following von Mises failure criteria:

$$2\sigma_Y^2=(\sigma_{ZZ}-\sigma_{00})^2+(\sigma_{00}-\sigma_{rr})^2+(\sigma_{rr}-\sigma_{ZZ})^2 \quad \text{(Equation 1)}$$

where:

$\sigma_Y$=equivalent stress, or max design stress $\sigma_{ZZ}$=axial stress=0 for open ended tubes $\sigma_{00}$=tangential stress $\sigma_{rr}$=radial stress The tangential stress ($\sigma_{00}$) may be determined using the following equation:

$$\sigma_{\theta\theta} = p_i * \frac{r_i^2}{r^2}\left[\frac{(r_0^2+r^2)}{(r_0^2-r_i^2)}\right] \quad \text{(Equation 2)}$$

where:

$p_i$=internal peak pressure $r_i$=internal radius of barrel or breach $r_0$=outer radius of barrel or breach r=is any selected point between $r_i$ and $r_o$ The radial stress ($\sigma_{rr}$) may be determined using the following equation:

$$\sigma_{rr} = p_i * \frac{r_i^2}{r^2}\left[\frac{(r_0^2-r^2)}{(r_0^2-r_i^2)}\right] \quad \text{(Equation 3)}$$

Using the above equations and the dimensions as set forth in FIGS. 4A and 4B, the estimated gun yield point of the barrel 228 may be determined. Preferably, the barrel 228 is made of a material with a high yield strength that exceeds the gun yield point. In one example, the barrel 228 has an inner radius ($r_i$1) of about 0.063 inches (0.16 cm) in the first portion 473, and an inner radius ($r_i$2) of about 0.136 inch (0.35 cm) in the second portion 474, an outer radius ($r_o$1) of about 0.20 inches (0.51 cm) at the firing end 240 and an outer radius ($r_o$2) of about 0.50 inches (1.27 cm) at the breech end 242. Using the above equations, the maximum stress for a 50,000 psi (344.74 MPa) internal peak pressure is about 158,917 psi (1095.69 MPa). Preferably, the barrel 228 is provided with a yield strength that is greater than the maximum stress, for this example, at least about 185,000-200,000 psi (1275.53-1378.95 MPa).

The breech 230*a,b* is shown in greater detail in FIGS. 5A1 and 5A2, and FIGS. 5B1 and 5B2. The breech 230*a,b* is externally threaded for connection with the barrel 228 and the tube 234, and internally threaded for connection with the contact 232*a,b* (see, e.g., FIGS. 2A and 2B). The breech has a breech passage 250*a,b* therethrough.

The breech 230*b* also has a scope passage 272 therethrough for supporting a scope therein during operation. A scope, such as the scope 122 shown in FIG. 1B, may be removably positionable in the scope passage 272 of the breech 230*b*. The scope 122 may be inserted into the scope passage 272 of the breech 230*a,b* and maintained therein by frictional engagement, or by providing a locking mechanism (not shown). The scope 122 may be selectively removable from the breech 230*b* for separate operation, if desired.

The breech 230*a,b* may be made of the same stainless steel used for the barrel 228. Preferably, the breech 230*a,b* is made of a strong material, such as steel, to support the barrel 228 and contact 230*a,b* during operation. The shape of the breech 230*a,b* is preferably configured to permit operative connection to the barrel 228 and the contact 232*a,b*. The barrel end 246*a,b* of the breech 230*a,b* is shaped to receive the breech end 242 of the barrel 228. The contact end 248*a,b* of the breech 230*a,b* is shaped to receive the contact 232*a,b*, and to operatively connect to the tubes and/or rod, if present (see, e.g., 234 and 264 of FIG. 2A). An inner surface of the breech 230*a,b* adjacent the contact 232*a,b* when in the assembled position may further provide grounding capabilities for the contact 232*a,b*.

The contact 232*a,b* is shown in detail in FIGS. 6A1 and 6A2, and FIGS. 6B1 and 6B2. As shown in these Figures, the cartridge end 252*a,b* of contact 232*a,b* is configured for electrical contact with the cartridge (e.g., 116*a* of FIG. 1). The contact 232*a,b* preferably is made of a conductive metal, such as aluminum, for passing electrical signals therethrough. The cartridge end 252*a,b* of contact 232*a,b* has an outer casing 475*a,b* that acts as a ground, and a contact pin 476*a,b* that acts as an electrical contact. Preferably, the contact pin 476*a,b* is configured to communicate electrical signals, such as voltage, from the initiator 138 to the cartridge 116*a,b* (see, e.g., FIGS. 2A and 2B). The contact pin 476*a,b* is also preferably configured to provide electrical signals, such as a voltage, to the cartridge 116*a,b* sufficient to electrically activate the cartridge.

Link end 254*a,b* of contact 232*a,b* may be threaded for operative connection to a tube 234 as shown in FIG. 6A2, if provided. Receptacle 256 extends from the link end 254*a,b* of the contact 232*a,b*. The receptacle 256 is adapted to receive the link 136 for operative connection therewith. The receptacle 256 receives electrical signals, such as a voltage, from the link 136 or another source, and passes such signals through the contact pin 476*a,b* to the cartridge 116*a,b*.

Figure 7A:
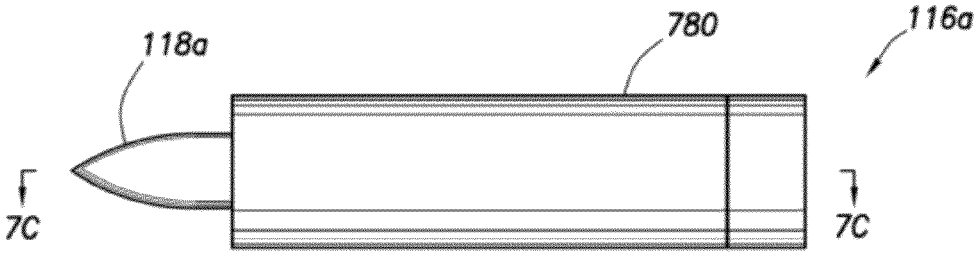
FIG. 7A is plan view of the cartridge of FIG. 1A having a firm projectile.
Figure 7B:
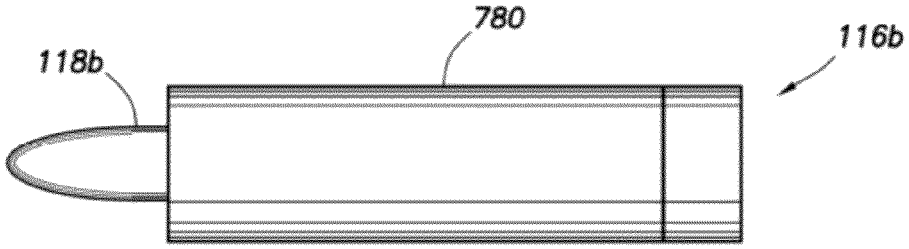
FIG. 7B is a schematic view of the cartridge of FIG. 1B having a frangible projectile.
Figure 7C:
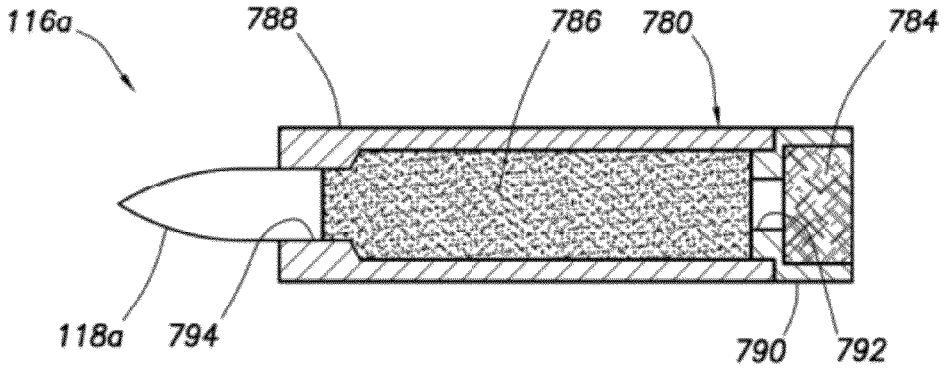
FIG. 7C is a longitudinal cross-sectional view of the cartridge of FIG. 7A taken along line 7C-7C.

FIGS. 7A-7C are detailed views of cartridges 116*a,b* of FIGS. 1A-1B. The cartridge 116*a,b* is preferably an electric cartridge activatable upon receipt of an electric signal. FIG. 7A shows a cartridge 116*a* with a firm projectile 118*a*. FIG. 7B shows a cartridge 116*b* with a frangible projectile 118*b*. FIG. 7C is a longitudinal cross-sectional view of the cartridge 116*a* of FIG. 7A showing the features of the cartridge 116*a* in greater detail.

As shown in FIGS. 7A and 7B, cartridge 116*a,b* has a housing 780 with a projectile 118*a,b* extending therefrom. The projectiles 118*a,b* are designed for deployment from a firing apparatus (e.g., 114*a,b* of FIGS. 1A,1B) and into an electrical component (e.g., 102*a,b* of FIGS. 1A, 1B). The projectiles 118*a,b* are preferably configured to penetrate and/or break at least a portion of the electrical component 102 to disrupt operation thereof.

The solid projectile 118*a* of FIG. 7A is preferably made of a tool steel material sufficiently strong to remain intact upon impact. The solid projectile 118*a* may be used, for example, to penetrate an electrical component (e.g., 110*a* of FIG. 1A) thereby disrupting its operation. The frangible projectile 118*b* of FIG. 7B is preferably made of a material that is strong enough to remain intact upon deployment, but fragile enough to break apart upon impact. For example, the projectile 118*b* may be made of a tungsten composite material with a copper jacket. The solid projectile 118*b* may be used, for example, to sever the wiring of an electrical component (e.g., 112 of FIG. 1B) thereby disrupting its operation.

The cartridge 116*a,b* and projectiles 118*a,b* are preferably of a miniature size for placement in the miniature firing apparatus 114*a,b* for activation therein (see, e.g., FIGS. 2A and 2B). This miniature sized projectile 118*a,b* is preferably sized for deployment through passage 244 of the firing apparatus 114*a,b* (see, e.g., FIG. 3). The cartridge 116*a,b* is also preferably sized such that the housing fits snugly within the passage 244 of the second portion 474 of the barrel 228, and such that the projectile 118*a,b* is deployable through the barrel passage 244 in the first portion 473 of the barrel 228 (see, e.g., FIG. 4B).

FIG. 7C is a longitudinal cross-sectional view of the cartridge 116*a* of FIG. 7A taken along line 7C-7C. As shown in this view, the cartridge 116*a* includes a projectile 118*a*, a primer 784, and a propellant 786, all positioned in housing 780.

The housing 780 is preferably configured to withstand a firing pressure generated by a cartridge 116*a,b* as it is activated within the barrel 228 during operation. While the firing pressure may vary depending on the cartridge and barrel configuration, the firing pressure preferably has a maximum of about 50,000 psi (344.74 MPa).

The housing 780 has a first portion 788 and a second portion 790 with a flash tube 792 therebetween. The housing 780 has a cartridge passage 794 therethrough extending through the first portion 788, the flash tube 792 and the second portion 790. The housing 780 may be of a material capable of supporting the propellant 786, primer 784 and projectile 118*a* during operation, such as an aluminum (e.g., 7075 T6 aluminum). The housing 780 is also preferably capable of handling the firing pressure generated during operation.

The primer 784 is positionable in the second portion 790 of the housing 780. The primer 784 is preferably configured for operative contact by contact pin 476*a,b* (see, e.g., FIG. 6A2). The primer 784 is preferably an electric primer electrically activatable by electrical communication of an electrical signal, such as a voltage, from the initiator (e.g., 138 of FIGS. 2A and 2B), through the contact 232*a* and to the primer 784 of cartridge 116*a*. The primer 784 may be made of, for example, a stainless steel primer, such as a WINCHESTER™ large rifle primer commonly used with ammunition. The primer may be electrically activated, for example, by receipt of an electrical signal from the contact (e.g., 232*a* of FIG. 2A). The primer 784 preferably ignites on receipt of such an electrical signal.

The propellant 786 is positionable between the projectile 118*a* and the primer 784. The propellant 786 is explosively ignitable upon activation of the primer 784. Once ignited by electrical contact, the propellant 786 creates pressure sufficient to deploy projectile 118*a,b* from the housing 780. The propellant 786 may be, for example, a double base pistol propellant with a high Nitroglycerin (of about 40% by weight), such as a BULLSEYE™ primer commonly used with ammunition. The cartridge 116*a,b* may be configured to operate at a given firing pressure. For example, to generate a maximum firing pressure of about 50,000 psi (344.74 MPa), about 1 gram of propellant may be used in the cartridge 116*a,b*.

Figure 8:
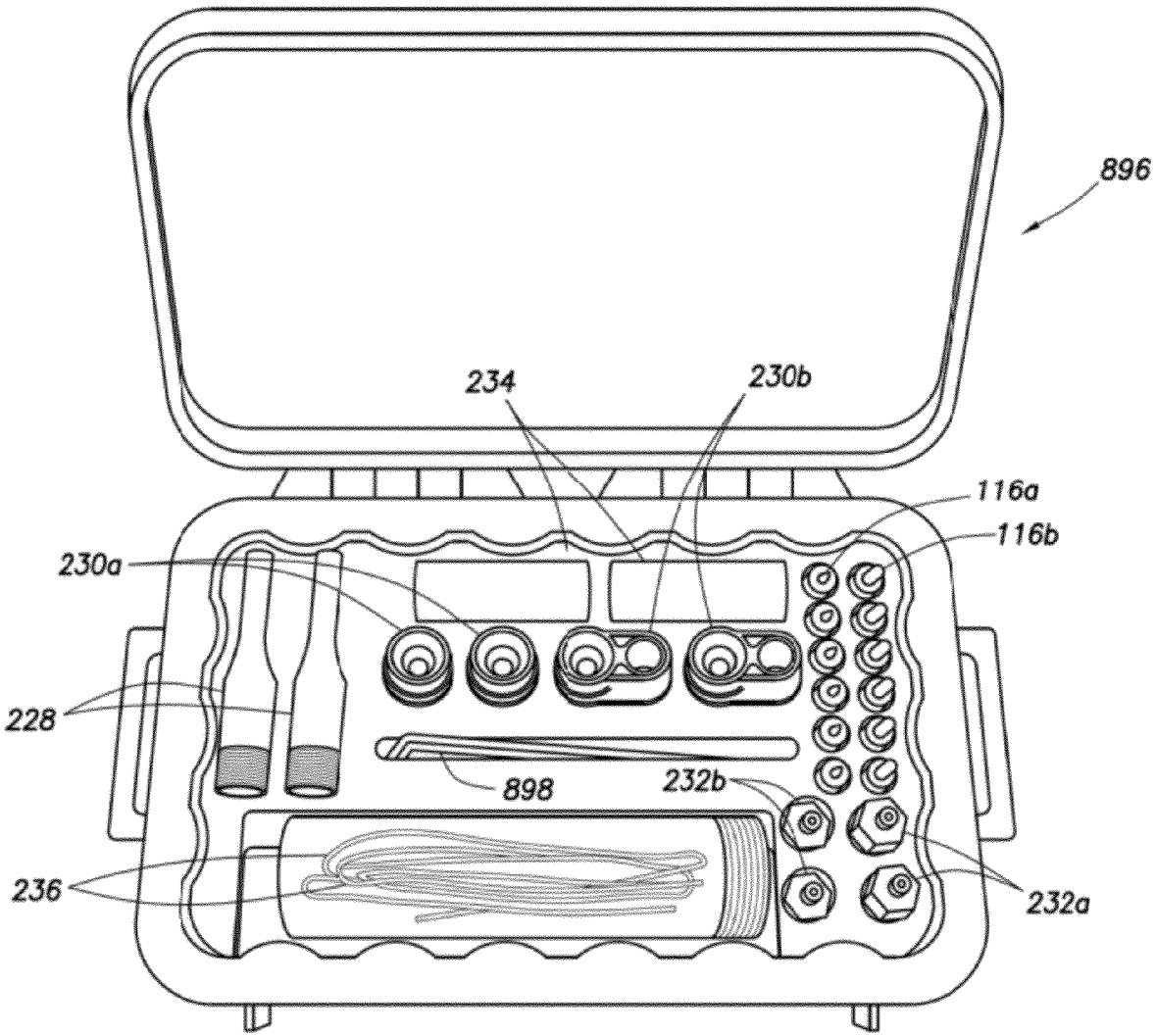
FIG. 8 is a graphical depiction of a carrying case containing, among other items, the firing apparatus of FIG. 1A and the firing apparatus of FIG. 1B.

FIG. 8 shows a carrying case 896 for carrying firing apparatuses (e.g., 114*a,b* of FIGS. 2A and 2B) for disrupting an electrical component. As depicted, the case 896 contains barrels 228, breeches 230*a,b*, contacts 232*a,b*, links 136, tubes 234 and cartridges 116*a,b*. The carrying case 896 also includes a tool 898 usable for assembling the apparatuses 114*a,b*, such as an alien wrench.

While the carrying case is shown as having certain parts and tools therein, it will be appreciated that the carrying case 896 may be used to carry various items used in connection with the operation of the system, apparatus and/or for performing various other operations. Such parts and tools may further include, for example, an initiator 138, a rod 264, a scope 122, tools, tape, and/or other items.

Figure 9:
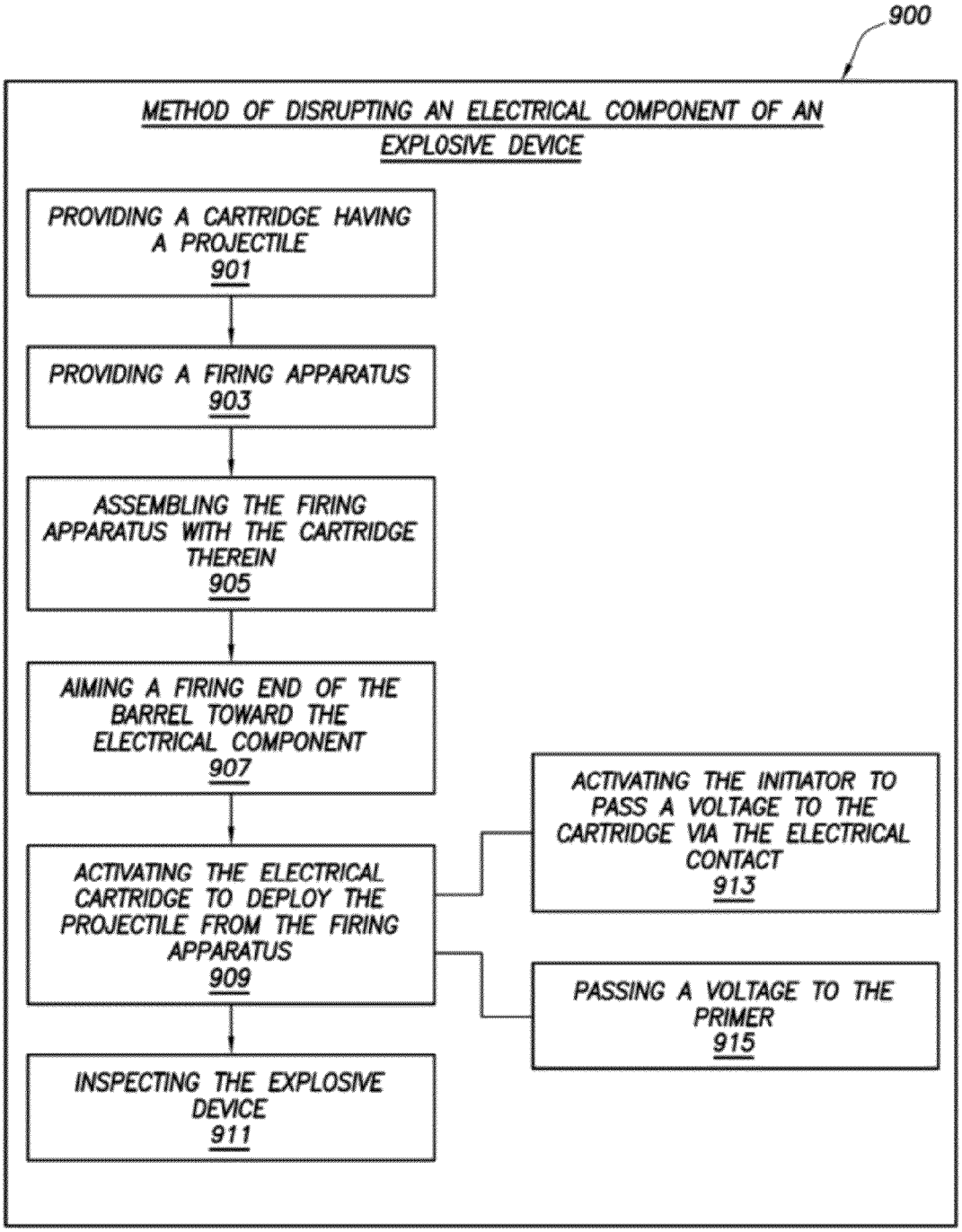
FIG. 9 is a flowchart depicting a method of disrupting an electrical component of an explosive device.

FIG. 9 is a flowchart depicting a method 900 for disrupting an electrical component 106 of an explosive device 104. The method includes providing 901*a* cartridge having a projectile (e.g., 116*a,b* and 118*a,b* of FIGS. 7A-7C), providing 903 a tiring apparatus (e.g., 114*a,b* of FIGS. 1A,1B,2A,2B), assembling 905 the firing apparatus with the cartridge therein (e.g., FIG. 114*b* of FIG. 3), aiming 907 a firing end of the barrel toward the electrical component (e.g., FIGS. 1A, 1B) and activating 909 the cartridge (e.g., 116*a,b* of FIGS. 7A-7C). The cartridge 116*a,b* may be activated to deploy the projectile 118*a,b* of the cartridge 116*a,b* from the firing apparatus 114*a,b* and into at least one electrical component 102 of the explosive device 104 (see, e.g., FIGS. 1A and 1B). Preferably, the projectile 118*a,b* is deployed into the explosive device 104 such that the at least one electrical component 102 of the explosive device 104 is disabled. The method may also involve inspecting 911 the explosive device (see, e.g., 122 of FIGS. 1A and 1B).

The step 905 of assembling may involve positioning the cartridge 118*a,b* in the barrel 228 and operatively connecting the barrel 228, the breech 230*a,b*, the contact 232*a,b* and the initiator 138 (see, e.g., FIGS. 2A and 2B). The step 909 of activating may involve activating 913 an initiator 138 to pass a voltage to the cartridge 116*a,b* via the contact 232*a,b* (see, e.g., FIGS. 1A and 1B). Preferably, the initiator 138 is activated such that the cartridge 116 is electrically activated to deploy the projectile 118*a,b* (see, e.g., FIGS. 1A and 1B). The step 909 of activating may also involve passing 915 a voltage to the primer 784. Preferably, the voltage ignites the primer 784 such that the propellant 786 is ignited. Once the propellant 786 is ignited, pressure is created to deploy the projectile 118*a,b* into the electrical component 102 (see, e.g., FIGS. 1A and 1B and 7A-7C).

The steps of the method are not necessarily in order and may be performed as desired. One or more steps may be repeated as desired. For example, the method may also include removing the housing 780 from the apparatus 114*a,b* after activating, and inserting a new cartridge 116*a,b* into the barrel 228. The steps of assembling 905 and activating 909 may then be repeated to fire one or more additional projectile 118*a,b*. In this manner, the firing apparatus 114*a,b* may be reloaded for repeated firing.

It will be understood from the foregoing description that various modifications and changes may be made in the preferred and alternative embodiments of the present invention without departing from its true spirit. For example, various devices, such as computers, communicators or other devices, may be used in combination with the firing apparatus. Such devices, may be used to signal, activate or otherwise operate the apparatus or provide communication with an operator.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an" and other singular terms are intended to include the plural forms thereof unless specifically excluded.

What is claimed is:

1. A firing apparatus for disrupting at least one electrical component of an explosive device, the apparatus comprising:

a barrel having a firing end aimable toward the at least one electrical component, the barrel having a passage therein for receiving an electrical cartridge, the electrical cartridge having a projectile at an end thereof deployable from the barrel and into the at least one electrical component;

a breech threadedly connectable to the barrel, wherein the breech comprises a breech passage therethrough;

an electrical contact positionable in the breech passage in operative contact with the electrical cartridge, the electrical contact threadedly connectable to the breech and operatively connectable to an initiator, wherein the initiator selectively provides an electrical signal to the electrical cartridge whereby the electrical cartridge is activated to deploy the projectile from the firing end of the barrel; and a scope positionable about the explosive device for inspection thereof.

2. The apparatus of claim 1, wherein the firing apparatus is sized for handheld operation.

3. The apparatus of claim 2, wherein the firing apparatus has a length of less than about 12 inches (30.48 cm).

4. The apparatus of claim 1, further comprising at least one tube operatively connectable to the breech, the at least one tube extending a length of the firing apparatus.

5. The apparatus of claim 4, further comprising a rod operatively connectable to the breech via the at least one tube, the rod extending a length of the firing apparatus.

6. The apparatus of claim 1, further comprising a link for electrically connecting the initiator to the electrical contact.

7. The apparatus of claim 6, wherein the initiator is located a distance from the firing apparatus for providing remote activation thereof.

8. The apparatus of claim 1, wherein the scope is operatively connectable to the breech.

9. The apparatus of claim 1, wherein the scope comprises:

a flexible body that comprises a lens and a camera that are operatively linked, wherein the camera captures images from the lens; and a screen that displays the images.

10. The apparatus of claim 9, wherein the screen is comprised in glasses.

11. The apparatus of claim 1, wherein the electrical contact has an outer casing and a pin, the outer casing providing an electrical ground, the pin positionable in contact with the electrical cartridge for providing the electrical signal thereto.

12. The apparatus of claim 1, wherein the projectile is firm.

13. The apparatus of claim 1, wherein the projectile is frangible.

14. The apparatus of claim 1, wherein the electrical signal comprises about 300 Volts.

15. A firing apparatus for disrupting at least one electrical component of an explosive device, the apparatus comprising:

a barrel having a firing end aimable toward the at least one electrical component, the barrel having a passage therein for receiving an electrical cartridge, the electrical cartridge having a projectile at an end thereof deployable from the barrel and into the at least one electrical component, wherein the electrical cartridge comprises:

a housing having a first portion and a second portion with a flash tube therebetween, the housing having a passage therethrough, the projectile positionable in the first portion of the housing;

a primer positionable in the second portion of the housing, the primer electrically ignitable upon receipt of an electrical signal; and a propellant positionable between the projectile and the primer, the propellant combustible upon ignition by the primer whereby the projectile is deployable from the housing;

a breech threadedly connectable to the barrel, wherein the breech comprises a breech passage therethrough; and an electrical contact positionable in the breech passage in operative contact with the electrical cartridge, the electrical contact threadedly connectable to the breech and operatively connectable to an initiator, wherein the initiator selectively provides the electrical signal to the electrical cartridge whereby the electrical cartridge is activated to deploy the projectile from the firing end of the barrel.

16. The apparatus of claim 15, wherein the firing apparatus is sized for handheld operation.

17. The apparatus of claim 15, further comprising at least one tube operatively connectable to the breech, the at least one tube extending a length of the firing apparatus.

18. The apparatus of claim 17, further comprising a rod operatively connectable to the breech via the at least one tube, the rod extending a length of the firing apparatus.

19. The apparatus of claim 15, further comprising a link for electrically connecting the initiator to the electrical contact.

20. The apparatus of claim 19, wherein the initiator is located a distance from the firing apparatus for providing remote activation thereof.

21. The apparatus of claim 15, further comprising a scope positionable about the explosive device for inspection thereof.

22. The apparatus of claim 21, wherein the scope is operatively connectable to the breech.

23. The apparatus of claim 21, wherein the scope comprises:

a flexible body that comprises a lens and a camera that are operatively linked, wherein the camera captures images from the lens; and a screen that displays the images.

24. The apparatus of claim 23, wherein the screen is comprised in glasses.

25. The apparatus of claim 15, wherein the electrical contact has an outer casing and a pin, the outer casing providing an electrical ground, the pin positionable in contact with the electrical cartridge for providing the electrical signal thereto.

26. A system for disrupting at least one electrical component of an explosive device, comprising:

an electrical cartridge having a projectile at an end thereof, the projectile deployable into the at least one electrical component;

a firing apparatus, comprising:

a barrel having a firing end aimable toward the at least one electrical component, the barrel having a passage therein for receiving the electrical cartridge;

a breech threadedly connectable to the barrel, wherein the breech comprises a breech passage therethrough; and an electrical contact positionable in the breech passage in operative contact with the electrical cartridge, the electrical contact threadedly connectable to the breech;

an initiator operatively connectable to the electrical contact, wherein the initiator selectively provides an electrical signal to the electrical cartridge whereby the electrical cartridge is activated to deploy the projectile from the firing end of the barrel; and a scope positionable about the explosive device for inspection thereof.

27. The system of claim 26, wherein the firing apparatus is sized for handheld operation.

28. The system of claim 26, further comprising at least one tube operatively connectable to the breech, the at least one tube extending a length of the firing apparatus.

29. The system of claim 28, further comprising a rod operatively connectable to the breech via the at least one tube, the rod extending a length of the firing apparatus.

30. The system of claim 26, further comprising a link for electrically connecting the initiator to the electrical contact.

31. The system of claim 26, wherein the electrical contact has an outer casing and a pin, the outer casing providing an electrical ground, the pin positionable in contact with the electrical cartridge for providing the electrical signal thereto.

32. The apparatus of claim 26, wherein the scope comprises:

a flexible body that comprises a lens and a camera that are operatively linked, wherein the camera captures images from the lens; and a screen that displays the images.

33. The apparatus of claim 32, wherein the screen is comprised in glasses.

34. A system for disrupting at least one electrical component of an explosive device, comprising:

an electrical cartridge having a projectile at an end thereof, the projectile deployable into the at least one electrical component, wherein the electrical cartridge comprises:

a housing having a first portion and a second portion with a flash tube therebetween, the housing having a passage therethrough, the projectile positionable in the first portion of the housing;

a primer positionable in the second portion of the housing, the primer electrically ignitable upon receipt of an electrical signal; and a propellant positionable between the projectile and the primer, the propellant combustible upon ignition by the primer whereby the projectile is deployable from the housing;

a firing apparatus, comprising:

a barrel having a firing end aimable toward the at least one electrical component, the barrel having a passage therein for receiving the electrical cartridge;

a breech threadedly connectable to the barrel, wherein the breech comprises a breech passage therethrough; and an electrical contact positionable in the breech passage in operative contact with the electrical cartridge, the electrical contact threadedly connectable to the breech; and an initiator operatively connectable to the electrical contact, wherein the initiator selectively provides the electrical signal to the electrical cartridge whereby the electrical cartridge is activated to deploy the projectile from the firing end of the barrel.

* * * * *